US008492672B2

(12) United States Patent
Shea

(10) Patent No.: US 8,492,672 B2
(45) Date of Patent: Jul. 23, 2013

(54) INSULATED ARC FLASH ARRESTER

(75) Inventor: John J. Shea, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 248 days.

(21) Appl. No.: 13/204,212

(22) Filed: Aug. 5, 2011

(65) Prior Publication Data

US 2013/0033796 A1 Feb. 7, 2013

(51) Int. Cl.
*H01H 33/02* (2006.01)

(52) U.S. Cl.
USPC ..... 218/43; 218/57; 218/118

(58) Field of Classification Search
USPC ..... 218/43–46, 57, 118
See application file for complete search history.

(56) References Cited

U.S. PATENT DOCUMENTS

| | | | | |
|---|---|---|---|---|
| 4,224,491 | A | 9/1980 | Kroon | |
| 4,935,590 | A * | 6/1990 | Malkin et al. | 218/57 |
| 5,661,280 | A * | 8/1997 | Kuss et al. | 218/43 |
| 6,633,009 | B1 | 10/2003 | Shea | |
| 6,657,150 | B1 | 12/2003 | Shea et al. | |
| 6,693,438 | B2 | 2/2004 | Shea | |
| 6,723,940 | B1 * | 4/2004 | Book et al. | 218/155 |
| 6,724,604 | B2 | 4/2004 | Shea | |
| 6,839,209 | B2 | 1/2005 | Shea et al. | |
| 7,035,068 | B2 | 4/2006 | Shea | |
| 7,145,757 | B2 | 12/2006 | Shea et al. | |
| 7,312,412 | B2 * | 12/2007 | Cravey et al. | 200/81 R |
| 2002/0063111 | A1 * | 5/2002 | Nishitani | 218/118 |
| 2011/0127237 | A1 * | 6/2011 | Uchii et al. | 218/46 |

FOREIGN PATENT DOCUMENTS

| | | | |
|---|---|---|---|
| DE | 197 46 813 | A1 | 4/1999 |
| DE | 10 2005 029076 | A1 | 1/2007 |
| EP | 2 073 235 | A1 | 6/2009 |
| EP | 2 194 556 | A1 | 6/2010 |

OTHER PUBLICATIONS

European Patent Office, "International Search Report and Written Opinion", Nov. 30, 2012, 11 pp.

* cited by examiner

*Primary Examiner* — Truc Nguyen
(74) *Attorney, Agent, or Firm* — Eckert Seamans Cherin & Mellott, LLC; Kirk D. Houser

(57) ABSTRACT

An arc flash arrester includes a fixed contact; a movable contact; an actuator mechanism structured to close the movable and fixed contacts; and insulation disposed between the fixed and movable contacts in an open position of the arc flash arrester. The insulation is selected from the group consisting of liquid insulation; $SF_6$; a gas, other than $SF_6$ or air, at a pressure of at least about one atmospheric pressure; and solid insulation.

27 Claims, 12 Drawing Sheets

INSULATED ARC FLASH ARRESTER

BACKGROUND

1. Field

The disclosed concept pertains generally to arc flash arresters and, more particularly, to arc flash arresters, such as, for example, shorting switches or other switching devices that arrest or quench an arc flash or arcing fault by closing open contacts.

2. Background Information

Electric power systems incorporate switches for control and protection purposes. Distribution systems, which form part of an overall electric power system, include main and branch power buses and circuit breakers mounted in metal cabinets to form switchgear. Interruption of current flow in the buses of the distribution system by a circuit breaker creates an arc as the contacts of the circuit breaker open. These arcs caused by interruption are contained and extinguished in the normal course of operation of the circuit breaker.

At times, however, unintended arcing faults can occur within switchgear cabinets, such as between power buses, or between a power bus and a grounded metal component. Such arcing faults can produce high energy gases, which pose a threat to the structure and nearby personnel. This is especially true when maintenance is performed on or about live power circuits. Frequently, a worker inadvertently shorts out the power bus, thereby creating an arcing fault inside the enclosure. The resulting arc blast creates an extreme hazard and could cause injury or even death. This problem is exacerbated by the fact that the enclosure doors are typically open for maintenance.

A common approach to protecting personnel from arcing faults in switchgear has been to design the metal enclosures to withstand the blast from the arcing fault. This has been done at great additional costs due to the heavy gauge metal used and numerous weld joints needed to prevent flying debris. Even with these precautions, the blast from an arcing fault inside the switchgear cannot be contained.

Recently, methods have been developed to minimize the severity of the blast from an internal arcing fault. These methods include pressure sensing and light detection, which sense the arcing fault within the switchgear and cause a circuit breaker to trip before significant damage can result. The pressure sensing method is limited by the insensitivity of the pressure sensors. By the time cabinet pressure has risen to detectable levels, the arcing fault has already caused significant damage.

In a medium voltage system, an internal arcing fault would occur somewhere inside of the switchgear enclosure, frequently, but certainly not limited to the point where the cables servicing the load are connected.

In a low voltage system, such as, for example, a motor control center, an internal arcing fault could occur within the load center panelboard when, for example, servicing live panelboards. A bare live copper bus could inadvertently be shorted. Another example for both low and medium voltage systems would be the shorting of the conductors by rodents, snakes, or other animals or objects.

In the low voltage system, the arcing fault could clear itself, by burning or ejecting the short, but it may take more than one-half cycle to do so, thereby causing significant damage and great risk of injury to workers even in one-half cycle of arcing.

A medium voltage system would behave similar to the low voltage system; however, the medium voltage system would be less likely to be self-extinguishing. The crowbarring of a shorting switch will extinguish the arc. Once the arc is out, and if the short has been burned away or removed, then system power can be restored.

It is known to employ a high-speed shorting switch to eliminate an arcing fault. Known arc elimination devices and systems produce a bolted fault across the power bus (e.g., phase-to-phase, such as two switches for three phases; phase-to-ground, such as three switches for three phases), in order to eliminate the arcing fault and prevent equipment damage and personnel injury due to arc blasts. It is also known to employ various types of crowbar switches for this purpose. The resulting short on the power bus causes an upstream circuit breaker to clear the bolted fault by removing power. See, for example, U.S. Pat. Nos. 7,145,757; 7,035,068; 6,839,209; 6,724,604; 6,693,438; 6,657,150; and 6,633,009. As a result, system power is lost due to the tripping of the upstream circuit breaker.

Known prior medium voltage shorting switches employ vacuum interrupters or vacuum envelopes having a partial vacuum therein.

Known prior low voltage shorting switches employ air at atmospheric pressure as an insulating medium.

There is room for improvement in arc flash arresters.

SUMMARY

These needs and others are met by embodiments of the disclosed concept, which provide an arc flash arrester in which insulation is disposed between fixed and movable contacts in an open position of the arc flash arrester, and the insulation is not air at less than or equal to a pressure of 0.10857 MPa, or the insulation is selected from the group consisting of liquid insulation; $SF_6$; a gas, other than $SF_6$ or air, at a pressure of at least about one atmospheric pressure; and solid insulation.

In accordance with one aspect of the disclosed concept, an arc flash arrester comprises: a fixed contact; a movable contact; an actuator mechanism structured to close the movable and fixed contacts; and insulation disposed between the fixed and movable contacts in an open position of the arc flash arrester, wherein the insulation is not air at less than or equal to a pressure of 0.10857 MPa.

The insulation may be a liquid insulation.

The insulation may be a pressurized gas insulation at a pressure of at least two atmospheric pressures.

The insulation may be a solid insulation.

The arc flash arrester may be structured to operate across a low voltage or across a medium voltage.

The insulation may be a liquid insulation or a gas insulation other than air disposed between the movable contact and the fixed contact, and touching the movable contact, the gas insulation other than air being pressurized at a pressure of at least one atmospheric pressure.

The insulation may be a liquid insulation or a gas insulation disposed between the movable contact and the fixed contact; and the liquid insulation or the gas insulation may be disposed in a chamber separate from the movable contact.

As another aspect of the disclosed concept, an arc flash arrester comprises: a fixed contact; a movable contact; an actuator mechanism structured to close the movable and fixed contacts; and insulation disposed between the fixed and movable contacts in an open position of the arc flash arrester, wherein the insulation is selected from the group consisting of liquid insulation; $SF_6$; a gas, other than $SF_6$ or air, at a pressure of at least about one atmospheric pressure; and solid insulation.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
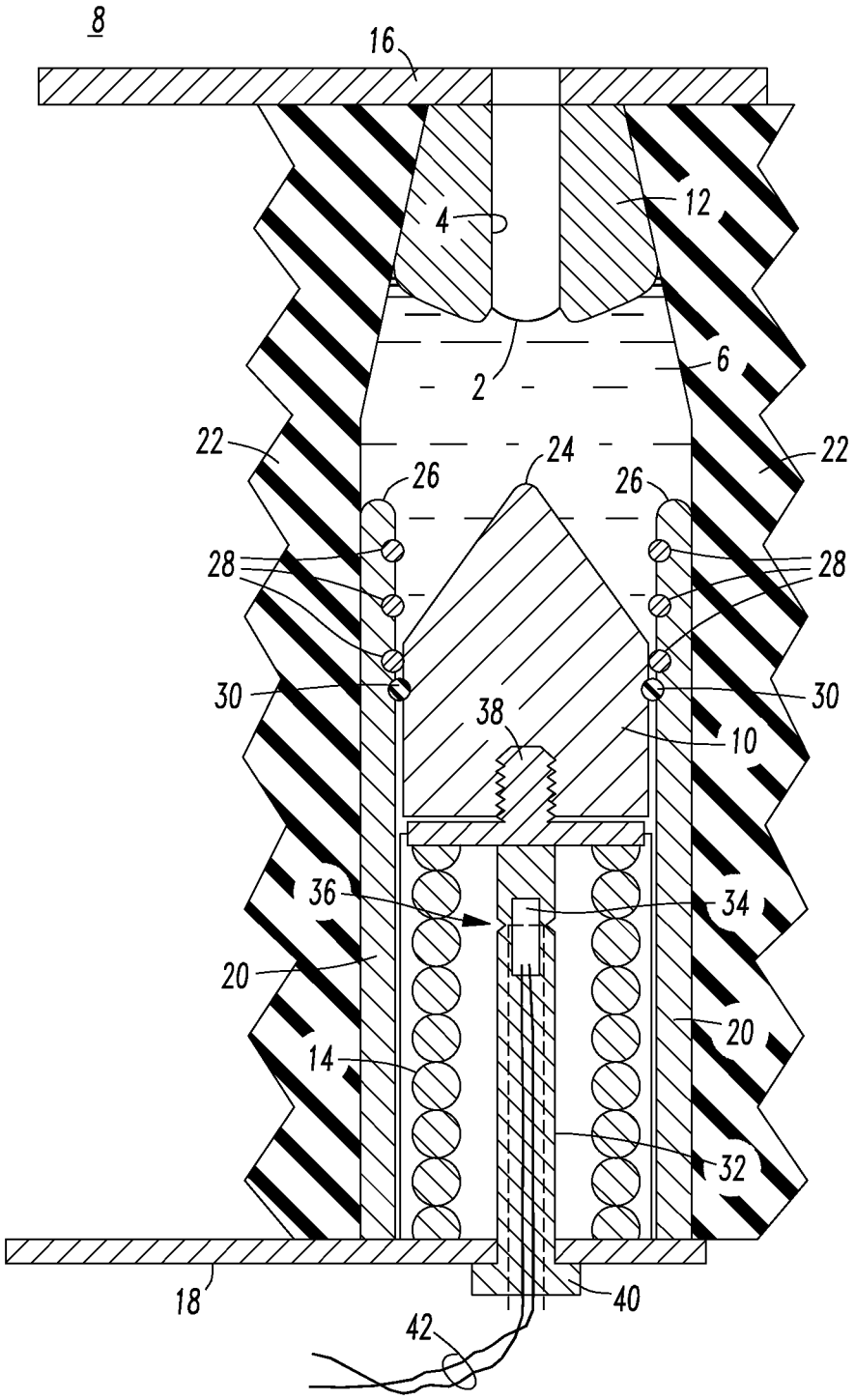
FIG. 1 is a cross sectional view of a liquid insulated arc flash arrester employing a compression spring in an open position in accordance with an embodiment of the disclosed concept.

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "vacuum envelope" means an envelope employing a partial vacuum therein.

As employed herein, the term "partial vacuum" means a space (e.g., within a vacuum envelope) partially exhausted (e.g., to the highest degree practicable; to a relatively high degree; to a degree suitable for use in an arc flash arrester application) by a suitable mechanism (e.g., without limitation, an air pump; a vacuum furnace).

As employed herein, the term "atmospheric pressure" means force per unit area exerted against a surface by gas pressure. For example and without limitation, average sea-level pressure is 101.325 kPa (1013.25 mbar, or hPa) or 29.921 inches of mercury (in Hg) or 760 millimeters (mmHg, or Torr) or about 14.696 psi. Atmospheric pressure varies with different weather conditions and different altitudes above or below sea-level on the Earth. For example, the highest known barometric pressure ever recorded on Earth was 1,085.7 hectopascals (hPa) (or 0.10857 MPa) (or 32.06 in Hg) measured in Tonsontsengel, Mongolia on Dec. 19, 2001.

As employed herein, the term "low voltage" means a voltage up to about 1 $kV_{RMS}$.

As employed herein, the term "medium voltage" means a voltage in the range from greater than a low voltage to about 38 $kV_{RMS}$.

As employed herein, the term "arc flash arrester" means a shorting switch or other switching device structured to arrest or quench an arc flash or arcing fault by closing open contacts.

As employed herein, the term "mineral oil" means a colorless, odorless, light mixture of alkanes in the C15 to C40 range from a non-vegetable (mineral) source (e.g., a distillate of petroleum).

As employed herein, the term "silicone oil" means a polymerized siloxane with organic side chains, or compounds including a chain formed of alternating silicon-oxygen atoms ( . . . Si—O—Si—O—Si . . . ) or siloxane. Other species attach to the tetravalent silicon atoms, not to the divalent oxygen atoms which are fully committed to forming the siloxane chain. A non-limiting example is polydimethylsiloxane, where two methyl groups attach to each silicon atom to form $(H_3C)[Si(CH_3)_2O]_nSi(CH_3)_3$.

As employed herein, the term "high temperature hydrocarbon" means a fluorinated hydrocarbon (e.g., without limitation, perfluorohexane).

As employed herein, the term "natural rubber" means an elastomer (an elastic hydrocarbon polymer) derived from latex, a milky colloid produced by some plants. For example and without limitation, a sticky, milk colored latex sap is collected from the plants and refined into natural rubber.

As employed herein, the term "butyl rubber" means a synthetic rubber, a copolymer of isobutylene with isoprene. Polyisobutylene, also known as "PIB" or polyisobutene, $(C_4H_8)_n$, is the homopolymer of isobutylene, or 2-methyl-1-propene, on which butyl rubber is based. Butyl rubber is produced by polymerization of about 98% of isobutylene with about 2% of isoprene.

As employed herein, the term "silicone rubber" means a rubber-like material composed of silicone—itself a polymer—containing silicon together with carbon, hydrogen, and oxygen. Silicone rubbers are widely used in industry, and there are multiple formulations. Silicone rubbers are often one- or two-part polymers, and may contain fillers to improve properties or reduce cost.

As employed herein, the term "air" means the atmosphere of the planet Earth. Dry air contains, for example and without limitation, about (by volume) 78.09% nitrogen, about 20.95% oxygen, about 0.93% argon, about 0.039% carbon dioxide, and small amounts of other gases.

Directional phrases used herein, such as, for example, top, bottom, front, back, left, right, upper, lower and derivatives thereof, relate to the orientation of the elements shown in the drawings and are not limiting upon the claims unless expressly recited therein.

The disclosed concept employs the combination of a suitable actuator mechanism (e.g., without limitation, a relatively fast compression spring release; an air bag actuator; an electromagnetic actuator; any suitable actuation device), with a suitable type of insulation media, other than air at less than or equal to a pressure of 0.10857 MPa for an internal medium voltage or low voltage arc flash arrester.

In the embodiments of FIGS. 1-5 and 7-11, electrically triggered switches quench an arcing fault by crow-barring the system voltage. Rather than employing vacuum insulation, the example switches employ a liquid insulation (FIGS. 1-5, 7 and 11) for voltage withstand. Alternatively, gas insulation (FIGS. 8 and 10) or solid insulation (FIG. 9) can be employed. These are one-time use devices that need to be replaced after operation.

Figure 2:
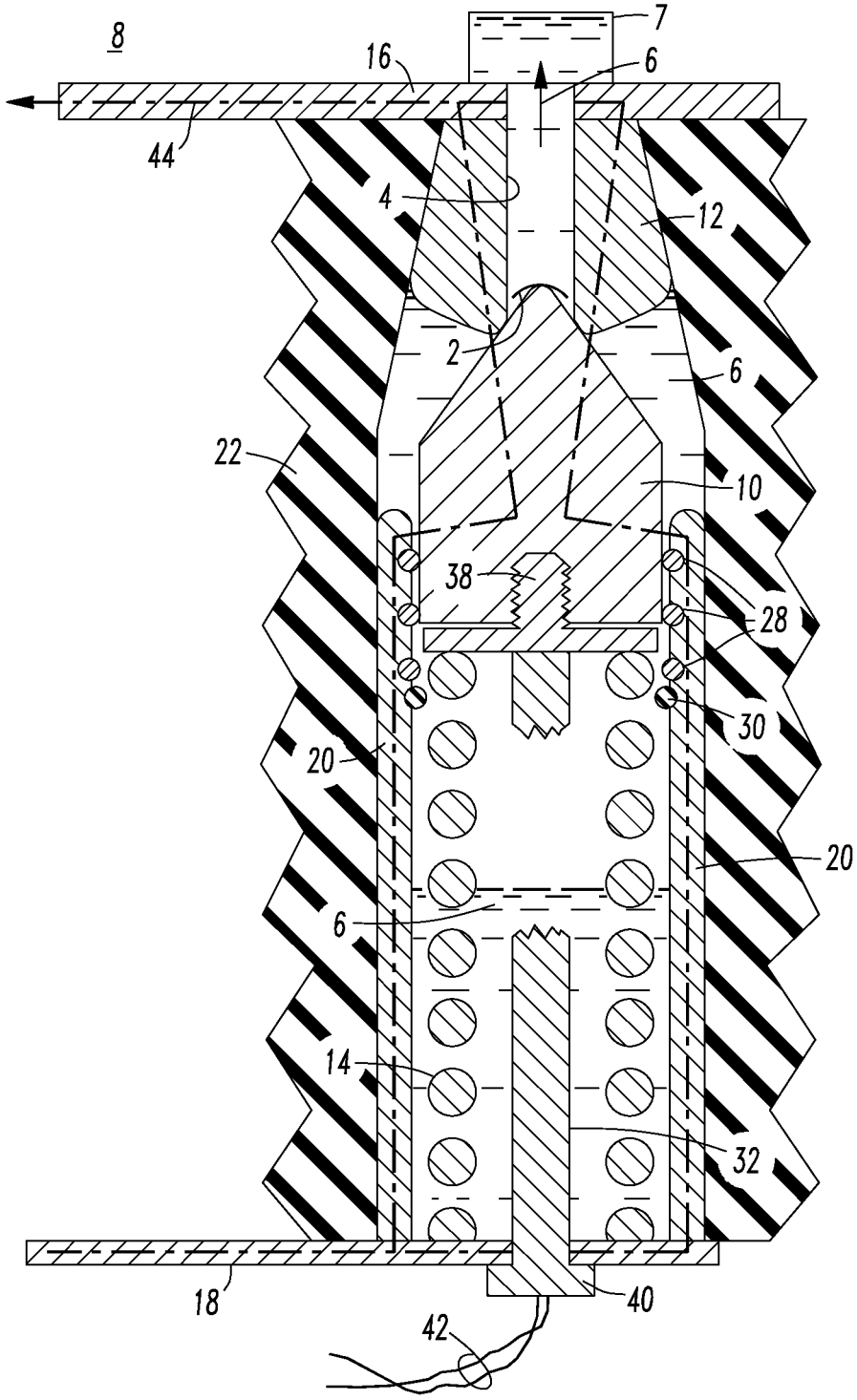
FIG. 2 is a cross sectional view of the liquid insulated arc flash arrester of FIG. 1 in a closed position.

A liquid can be employed to provide adequate insulation between switch electrodes. In the example of FIGS. 1 and 2, a diaphragm 2 and a liquid exhaust port 4 are employed to allow some of liquid insulation 6 to be expelled out of an arc flash arrester 8 during operation, thereby allowing a movable contact 10 to move and contact a fixed contact 12, as shown in FIG. 2.

FIG. 1 shows the open position of the liquid insulated arc flash arrester 8, which includes an actuator in the form of an example compression spring 14. The arc flash arrester 8 is connected between two example stainless steel busses 16,18. As shown in FIG. 1, the example fixed contact 12 can be made, for example and without limitation, from a suitable conductor, such as copper or steel. Although a rounded face facing the movable contact 10 is shown, a flat face or other suitable face could alternatively be employed. The example movable contact 10 can be made, for example and without limitation, from a suitable conductor, such as copper, and is in the shape of an example bullet. An actuator mechanism, such as the example compression spring 14, is structured to close the movable and fixed contacts 10,12, as shown in FIG. 2. The example liquid insulation 6 is disposed between the fixed and movable contacts 12,10 in the open position of FIG. 1.

The movable contact 10 and the compression spring 14 are disposed within a suitable conductor, such as the example copper tube 20. An external solid insulator 22 houses the fixed contact 12, the diaphragm 2, the liquid exhaust port 4, the liquid insulation 6, the copper tube 20, the movable contact 10 and the compression spring 14 between the busses 16,18. Preferably, the ends 24,26 of the respective movable contact 10 and the copper tube 20 are rounded as facing the fixed contact 12. Sliding contacts 28 permit the movable contact 10 to slide within the copper tube 20 from the open position of FIG. 1 to the closed position of FIG. 2. In the open position of FIG. 1, the liquid insulation 6 is maintained between the movable contact 10 and the fixed contact 12 by the solid insulator 22 and by an o-ring 30 disposed between the movable contact 10 and the copper tube 20.

The various radius metal ends 24,26 are employed to reduce the electric field in order to prevent unintended breakdowns. Otherwise, relatively sharp edges would increase the electric field. Providing a smooth radius also allows for a relatively more compact design.

The example actuator includes the compression spring 14 disposed between the bus 18 and the movable contact 10, a bolt 32 having a charge 34 disposed therein and an associated break line 36. One end 38 of the bolt 32 is threaded into the movable contact 10 and the other end 40 of the bolt 32 engages the bus 18. A pair of actuator wires 42 exits the bolt 32 and is employed to actuate the charge 34, which fractures the bolt 32 at the break line 36, thereby releasing the spring 14 to drive the movable contact 10 into the fixed contact 12, which weld together as shown in FIG. 2.

FIG. 2 shows the closed or shorted position including the current path 44, which passes through the bus 18, the copper tube 20, the movable contact 10, the fixed contact 12, and the bus 16. During the closing, the diaphragm 2 is ruptured and a portion of the liquid insulation 6 is ejected through the liquid exhaust port 4, while another portion of the liquid insulation 6 flows past the o-ring 30 to the lower (with respect to FIG. 2) portion of the arc flash arrester 8.

Figure 11:
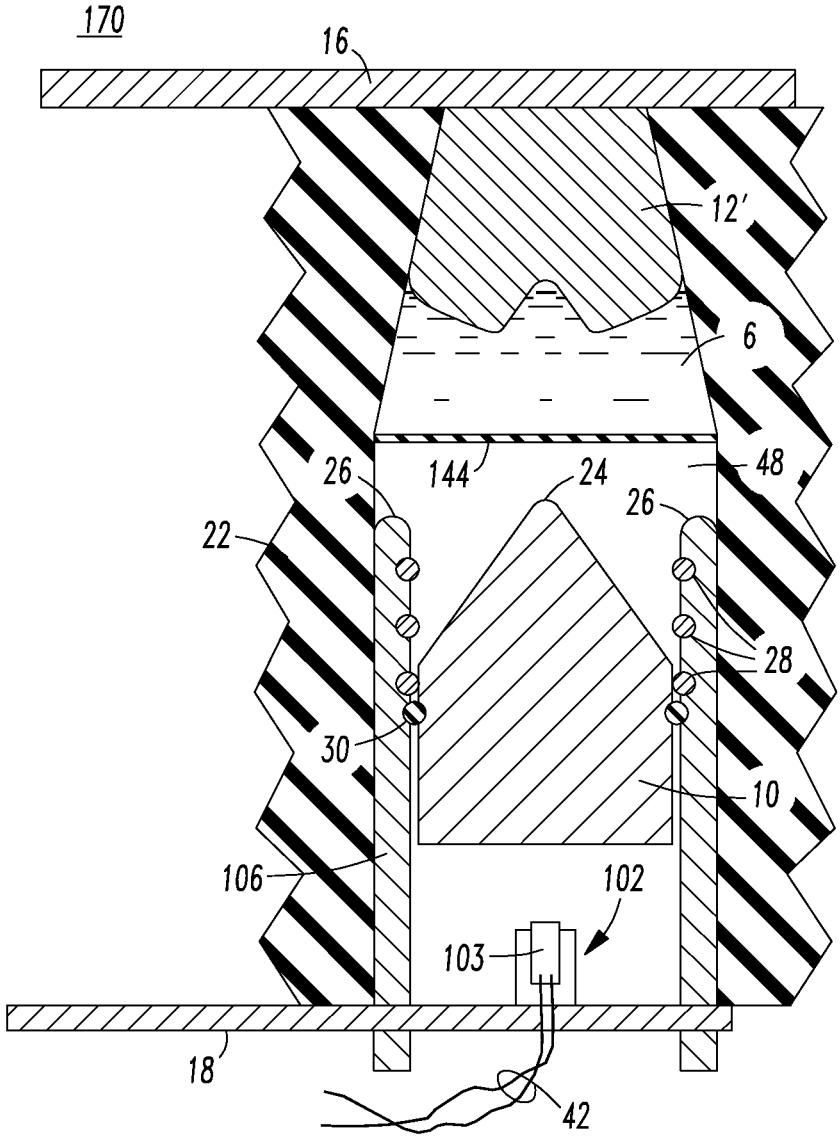
FIG. 11 is a cross sectional view of a liquid insulated arc flash arrester employing an air bag actuator in an open position in accordance with another embodiment of the disclosed concept.

Although FIG. 1 shows only liquid insulation 6 between the movable and fixed contacts 10,12, alternatively, as shown in FIG. 11, the liquid insulation 6 can be disposed above (with respect to FIG. 11) solid insulation 46 and air 48.

The minimum gap spacing that will allow for an example typical BIL (basic insulation level) voltage of 95 kV in medium voltage applications (or a lower voltage for low voltage applications (i.e., 14.8 $kV_{PEAK}$ and lower)) can be employed. A relatively smaller gap spacing provides a relatively shorter closing time for a particular closing force. The example of FIG. 1 can employ an example 1 cm gap between the fixed and movable contacts 10,12 in the open position. In this example, a suitable dielectric has at least about 95 kV/cm breakdown strength. As another example, a 2 cm gap for a medium voltage application can employ a breakdown strength of at least about 50 kV/cm.

Various example liquids and their corresponding dielectric strengths as disclosed in Table 1, below, can be employed as the example liquid insulation 6. Many of these liquids have dielectric strengths that are about three to about ten times higher than the example 95 kV/cm breakdown strength. This allows for added margin or, alternatively, the contact gap can be reduced for relatively shorter closing times. For example, when using a silicone oil, the contact gap could be about 0.3 cm and still be sufficient for BIL withstand requirements. A person of ordinary skill in the relevant art will appreciate the need to account for field enhancement produced from the geometry of the contact electrodes of the fixed and movable contacts 10,12. The values in Table 1 are for a uniform field sphere gap. Those values can be reduced by non-uniform fields produced by this geometry.

TABLE 1

| Liquid | Breakdown Strength (kV/cm) |
|---|---|
| Mineral oil (50 ppm water) | 150 |
| Pure mineral oil | 1000 |
| Polybutylene | 300 |
| Alkyl-Benzene | 300 |
| Silicone oil | 300 |
| Tetrachloroethylene | 400 |
| High temperature hydrocarbon | 400 |
| Perfluoropolyether | 400 |

Figure 3:
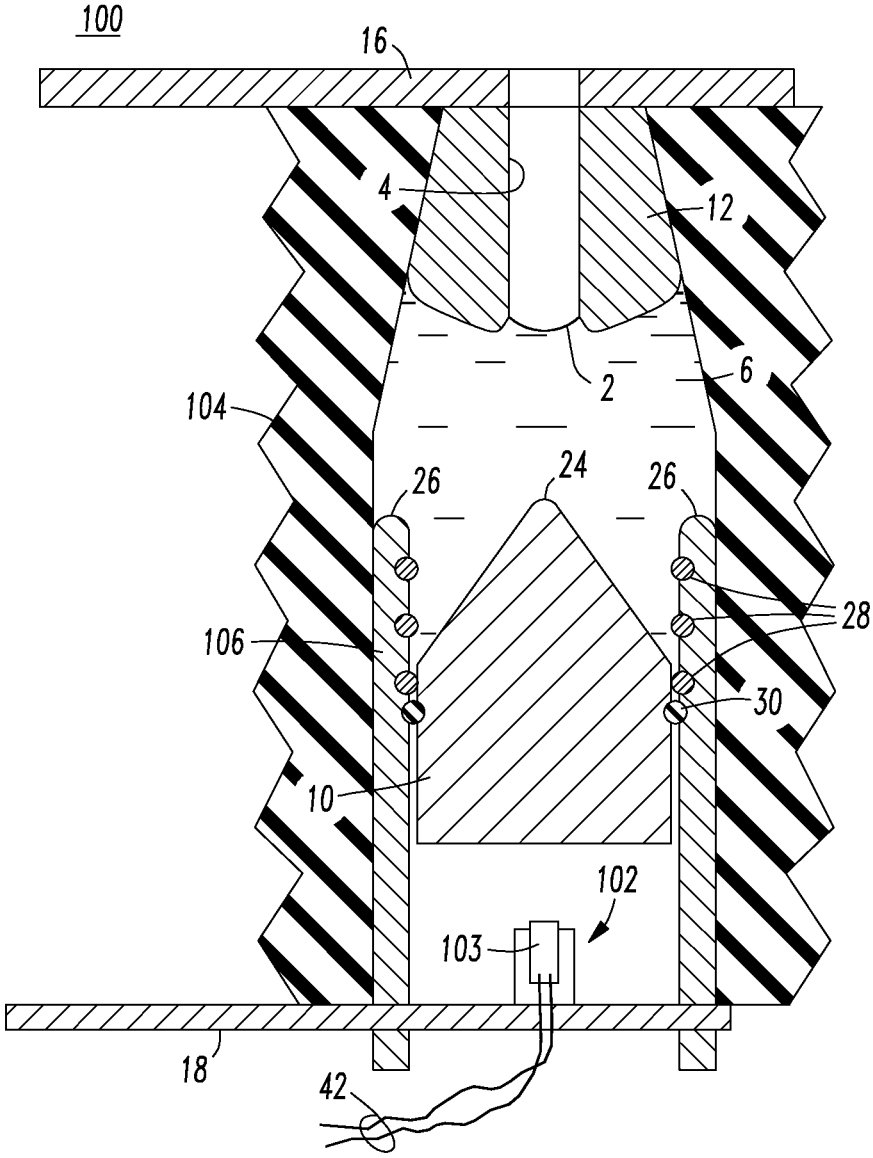
FIG. 3 is a cross sectional view of a liquid insulated arc flash arrester employing an air bag actuator in an open position in accordance with another embodiment of the disclosed concept.

FIG. 3 shows the open position of a liquid insulated arc flash arrester 100 including an actuator, such as the example air bag actuator 102 having an air bag charge 103. Generally, the liquid insulated arc flash arrester 100 is similar to the liquid insulated arc flash arrester 8 of FIG. 1, except that the actuator mechanism is different and employs the air bag actuator 102 instead of the compression spring 14. Also, in this example, the lengths of the solid insulator 104 and the copper tube 106 can be reduced with respect to the lengths of the solid insulator 22 and the copper tube 20 of FIG. 1. The air bag charge 103 can be actuated in a similar fashion as the compression spring 14 of FIG. 1 by similarly energizing the pair of wires 42.

Figure 4:
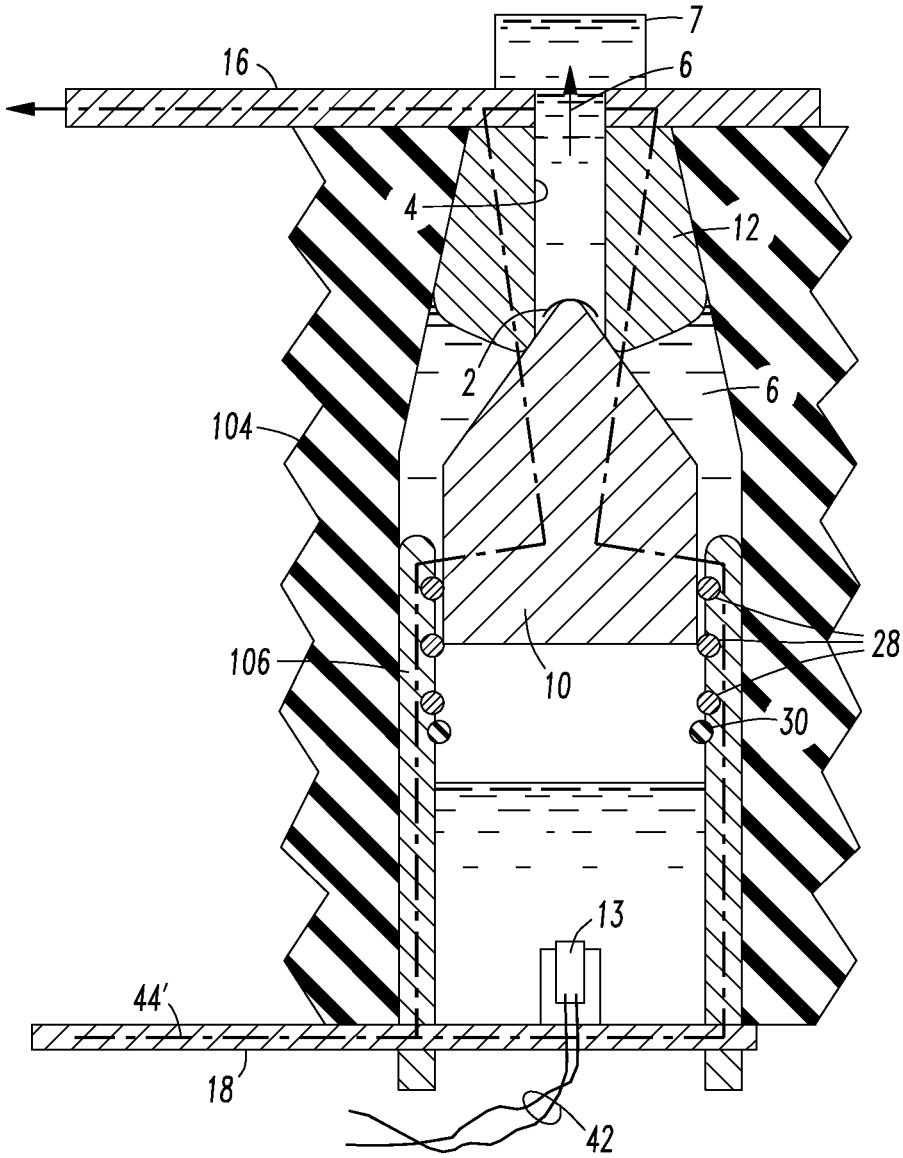
FIG. 4 is a cross sectional view of the liquid insulated arc flash arrester of FIG. 3 in a closed position.

FIG. 4 shows the closed or shorted position including the current path 44' of the liquid insulated arc flash arrester 100 of FIG. 3. After the air bag charge 103 is actuated, the charge 103 drives the movable contact 10 into the fixed contact 12, which weld together as shown in FIG. 4. The current path 44' passes through the bus 18, the copper tube 106, the movable contact 10, the fixed contact 12, and the bus 16. During the closing, the diaphragm 2 is ruptured and a portion of the liquid insulation 6 is ejected through the liquid exhaust port 4, while another portion (not shown) of the liquid insulation 6 flows past the o-ring 30 to the lower (with respect to FIG. 4) portion of the arc flash arrester 100.

Although FIG. 3 shows only liquid insulation 6 between the movable and fixed contacts 10,12, alternatively, as shown in FIG. 11, the liquid insulation 6 can be disposed above (with respect to FIG. 11) the solid insulation 46 and air 48.

Figure 5:
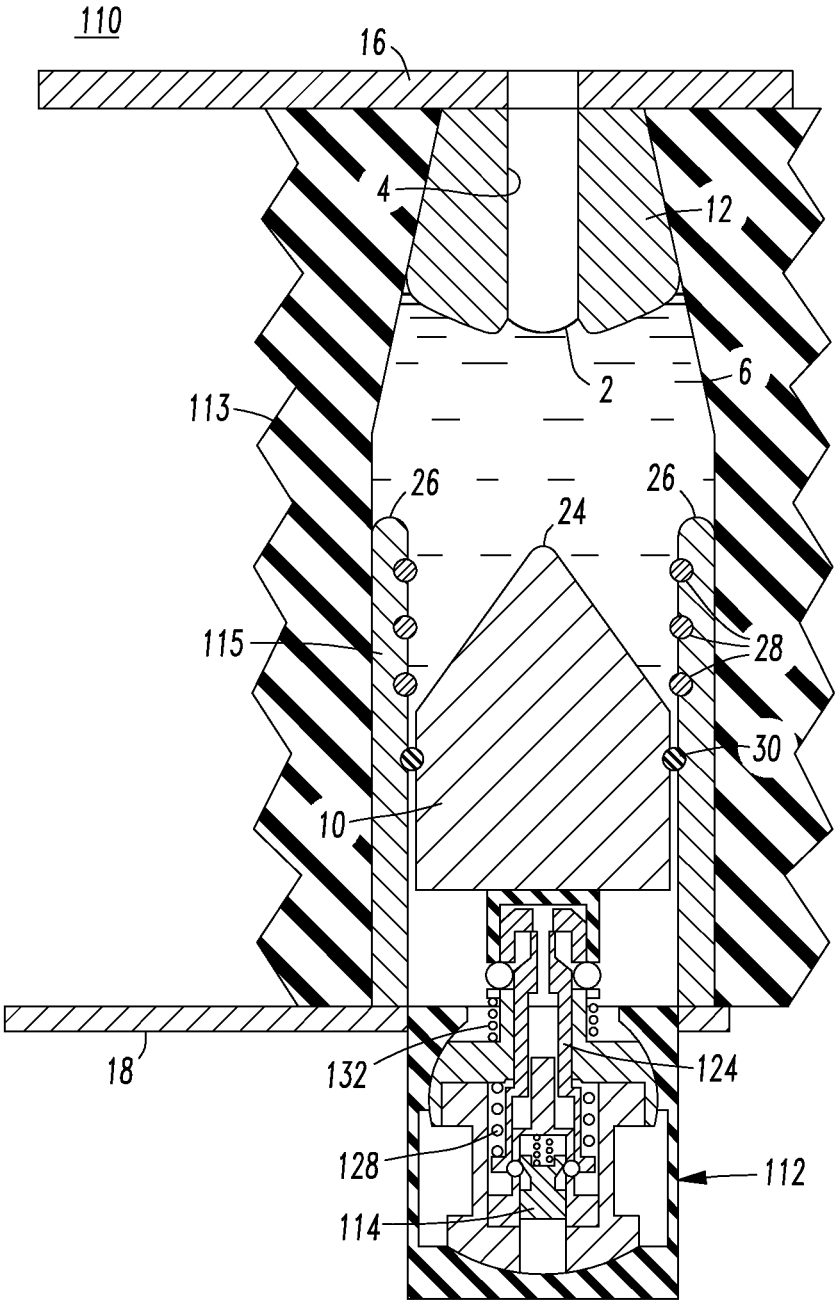
FIG. 5 is a cross sectional view of a liquid insulated arc flash arrester employing an electromagnetic actuator in an open position in accordance with another embodiment of the disclosed concept.

FIG. 5 shows the open position of a liquid insulated arc flash arrester 110 including an electromagnetic actuator 112. Generally, the liquid insulated arc flash arrester 110 is similar to the liquid insulated arc flash arrester 8 of FIG. 1, except that the actuator mechanism is different and employs the electromagnetic actuator 112 instead of the compression spring 14. Also, in this example, the lengths of the solid insulator 113 and the copper tube 115 can be reduced with respect to the lengths of the solid insulator 22 and the copper tube 20 of FIG. 1. The electromagnetic actuator 112 can be actuated in a similar fashion as the compression spring 14 of FIG. 1 by similarly energizing a pair of wires (not shown).

Figure 6B:
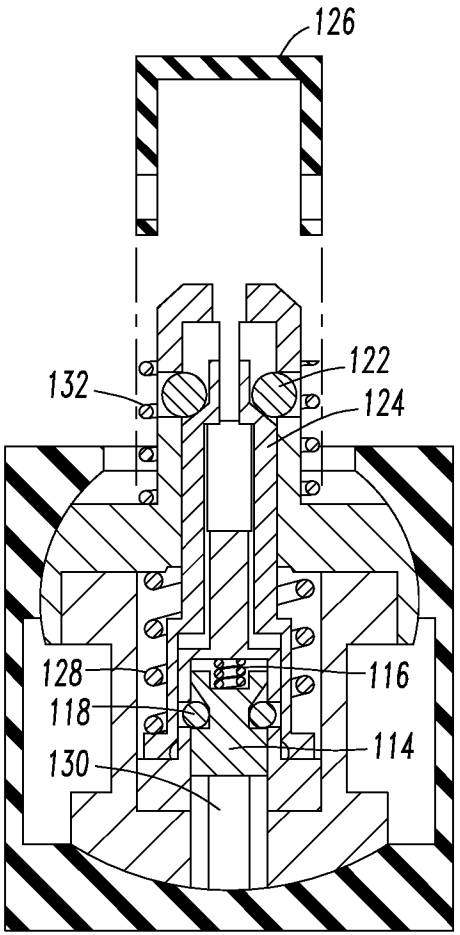
FIG. 6B is a cross sectional view of the electromagnetic actuator of FIG. 5 in a closed position.
Figure 6A:
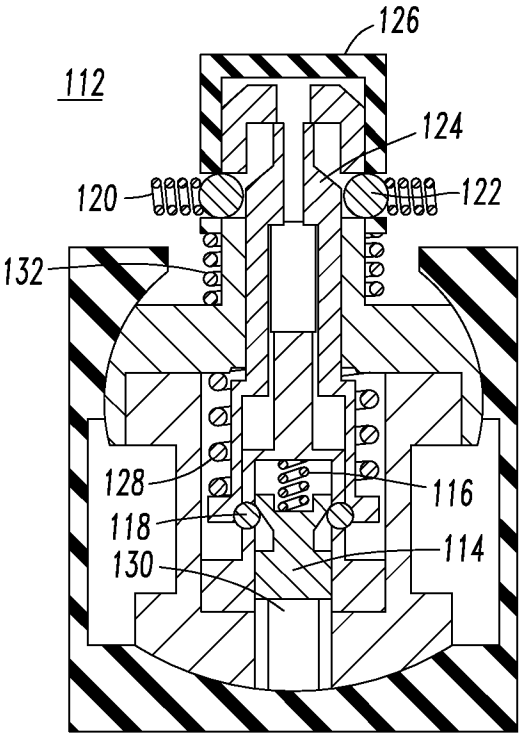
FIG. 6A is a cross sectional view of the electromagnetic actuator of FIG. 5 in the open position.

FIGS. 6A-6B show the operation of the example electromagnetic actuator 112 of FIG. 5. Referring to the open position of FIG. 6A, a shaft 114 functions as a latch and holds ball bearings 118 in an initial locked or latched position. In this position, the ball bearings 118 prevent a pin or shaft 124 from moving downward (with respect to FIG. 6A). A spring 116 forces the shaft 114 downward (with respect to FIG. 6A) holding the ball bearings 118 in the locked position.

Upon actuation, as will be described, the shaft 124 moves downward (with respect to FIG. 6A) from the force of a drive spring 128. In turn, a spring 120 loading ball bearings 122 moves inward releasing an end cap 126. An upper kickoff spring 132 drives the end cap 126 upward (with respect to FIG. 6B).

As shown in FIG. 6B, upon actuation by a current pulse, a Nitinol element 130 expands lengthwise, pushing up (with respect to FIG. 6B) the shaft 114, thereby releasing the ball bearings 118 and allowing the shaft 124 to move downward (with respect to FIG. 6B). Alternatively, other suitable actuators may be employed, such as a solenoid (not shown).

Figure 7:
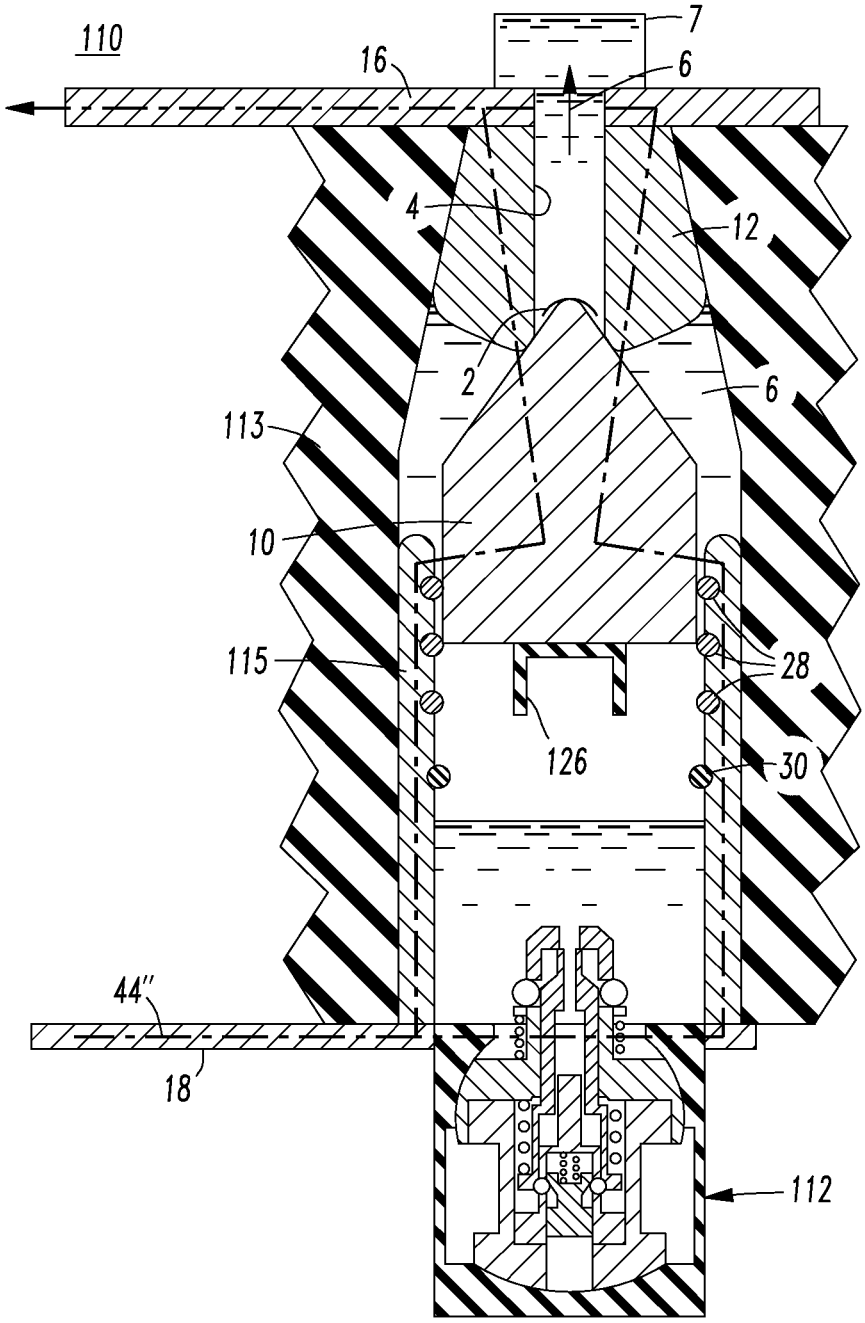
FIG. 7 is a cross sectional view of the liquid insulated arc flash arrester of FIG. 5 in a closed position.

As shown in FIGS. 5 and 7, the end cap 126 is coupled to the movable contact 10 (e.g., without limitation, bullet), or can form the bullet (not shown).

FIG. 7 shows the closed or shorted position of the liquid insulated arc flash arrester 110 of FIG. 5 after the electromagnetic actuator 112 releases the end cap 126 and the movable contact 10. The end cap 126 drives the movable contact 10 into the fixed contact 12, which weld together as shown in FIG. 7. The current path 44" passes through the bus 18, the copper tube 115, the movable contact 10, the fixed contact 12, and the bus 16. During the closing, the diaphragm 2 is ruptured and a portion of the liquid insulation 6 is ejected through the liquid exhaust port 4, while another portion (not shown) of the liquid insulation 6 flows past the o-ring 30 to the lower (with respect to FIG. 7) portion of the arc flash arrester 110.

Although FIG. 5 shows only liquid insulation 6 between the movable and fixed contacts 10,12, alternatively, as shown in FIG. 11, the liquid insulation 6 can be disposed above (with respect to FIG. 11) the solid insulation 46 and air 48. As shown in FIG. 2, the liquid insulated arc flash arresters 8, 100 and 110 of FIGS. 1-5 and 7 can employ an enclosure 7 to capture the ejected liquid insulation 6.

In addition to liquid insulation, gas insulation can also provide adequate insulation between switch contacts or electrodes. A gas of sufficient dielectric strength can be employed in place of the liquid insulation 6 in the arc flash arresters 8,100,110 of FIGS. 1-5 and 7.

The minimum gap spacing that will allow for an example typical BIL voltage of 95 kV in medium voltage applications (lower for low voltage applications) is generally employed. Again, a relatively smaller gap spacing provides a relatively shorter closing time for a particular closing force. The example gas insulated arc flash arrester 140 of FIG. 8 employs a 1 cm contact gap. In this example, a suitable dielectric has about 95 kV/cm breakdown strength.

Pressurizing any gas over atmospheric pressure will raise the breakdown strength of the gas. Thus, pressurizing the gas allows the placement of the opposing contacts closer together because of the increased breakdown strength. Some gases, compared to air, will have a relatively higher breakdown strength at a given pressure (e.g., $SF_6$ or $N_2$).

Air at atmospheric pressure only withstands about 30 kV/cm, but air at about two atmospheric pressures (e.g., at about 29.392 psi) would withstand about 100 kV/cm as per Paschen's law. Other gases, such as $SF_6$, could be employed at one atmospheric pressure since it has about 89 kV/cm breakdown strength. This would employ, for example, about a 1.07 cm contact gap. Other suitable gases could be employed under pressure to satisfy this requirement (e.g., nitrogen).

Figure 8:
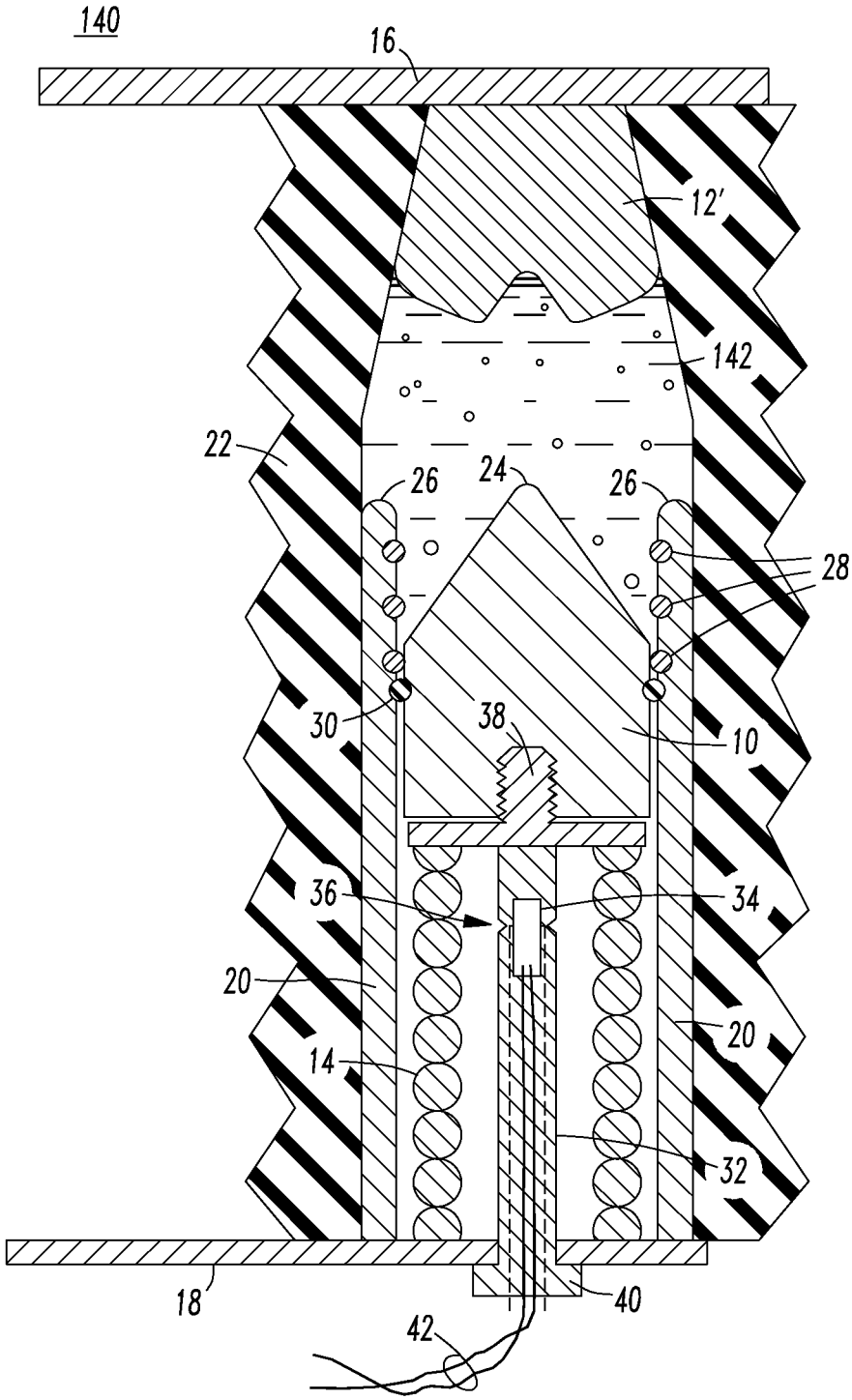
FIG. 8 is a cross sectional view of a gas insulated arc flash arrester employing a compression spring in an open position in accordance with another embodiment of the disclosed concept.

FIG. 8 shows the open position of the gas insulated arc flash arrester 140 including the compression spring 14 of FIGS. 1 and 2. It will be appreciated, however, that any of the mechanisms of FIG. 3-5, 6A-6B, or 7 can alternatively be employed. Generally, the gas insulated arc flash arrester 140 is similar to the liquid insulated arc flash arrester 8 of FIG. 1, except that gas insulation 142 is employed instead of the liquid insulation 6 of FIG. 1, and except that the fixed contact 12' does not employ a diaphragm 2 or a liquid exhaust port 4. A person of ordinary skill in the art will recognize that the liquid insulation 6 of FIG. 1 cannot be compressed and needs to exit the liquid exhaust port 4, whereas the gas insulation 142 of FIG. 8 may be compressed during initial movement of the movable contact 10. Otherwise, closure of the gas insulated arc flash arrester 140 operates similar to that of the liquid insulated arc flash arrester 8 of FIG. 1.

Upon closure (not shown), the current path (not shown) passes through the bus 18, the copper tube 20, the movable contact 10, the fixed contact 12', and the bus 16. During the closing, a portion (not shown) of the gas insulation 142 may flow past the o-ring 30 to the lower (with respect to FIG. 8) portion of the arc flash arrester 140.

Figure 10:
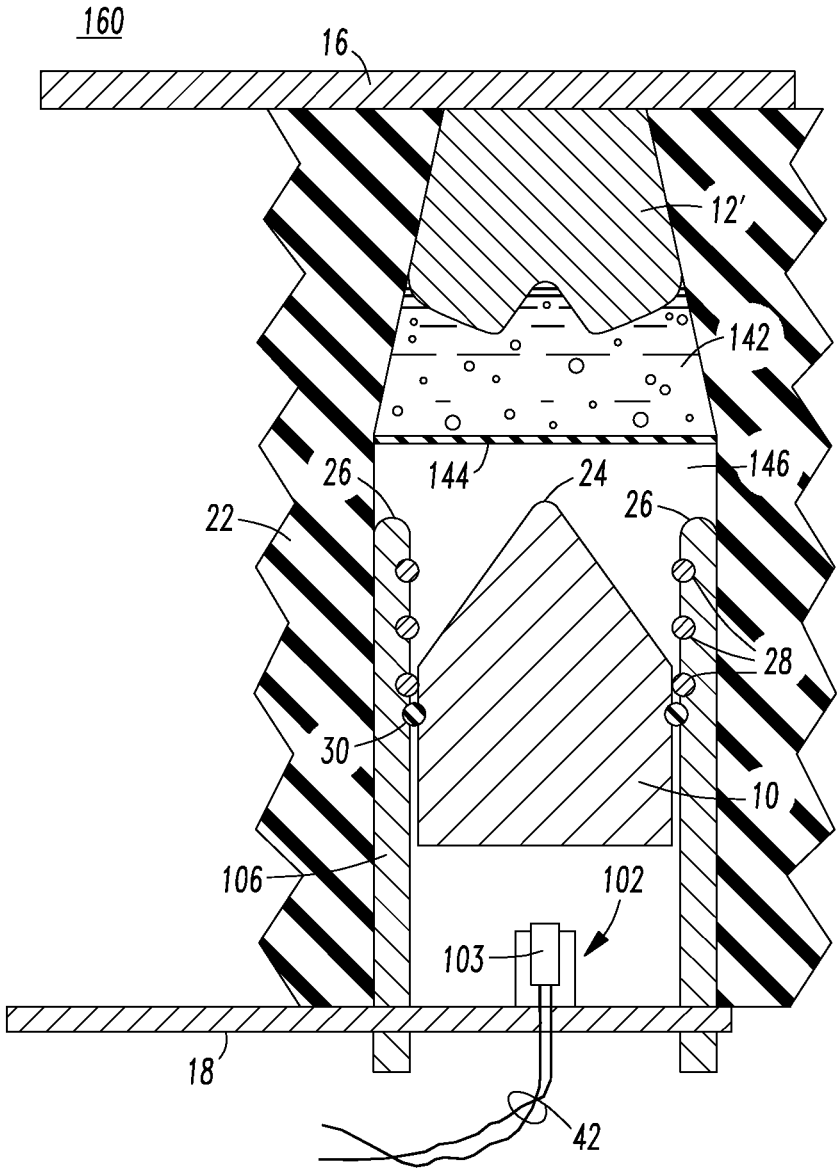
FIG. 10 is a cross sectional view of a gas insulated arc flash arrester employing an air bag actuator in an open position in accordance with another embodiment of the disclosed concept.

Although FIG. 8 shows only gas insulation 142 between the movable and fixed contacts 10,12, alternatively, as shown in FIG. 10, the gas insulation 142 can be disposed above (with respect to FIG. 10) solid insulation 144 and air 146.

For a gas insulation, such as 142, the desired pressure depends upon the type of gas and the electrical requirements imposed on the example gas insulated arc flash arrester 140. The BIL voltage requirement depends upon the system operating voltage. For 38 kV rated systems, for example, the BIL is 95 kV, so the breakdown voltage of the contact gap formed between the example movable and fixed contacts 10,12' needs to be at least 95 kV. The breakdown strength of a given gas depends upon the pressure. Breakdown strength increases with pressure above atmospheric pressure. So, for example, to hold-off a 95 kV voltage impulse at an example 1 cm gap, the breakdown strength would need to be 95 kV/cm. In contrast, liquid or solid insulation is not pressure dependent. Pressurized air could be used as the dielectric gas.

Low voltage systems have a different BIL requirement.

For IEC 947-2, there is a table of values. The highest BIL voltage is 14.8 kV.

For UL489, there is no BIL requirement, but there is a dielectric withstand of two times the voltage rating plus 1 kV (typically, 2200 $V_{RMS}$). Paschen's equation can be used to estimate the breakdown strength of a gas.

For the disclosed concept, gas pressure of a gas other than air is equal to or greater than atmospheric pressure.

For example, the insulation is not air at less than or equal to a pressure of 0.15 MPa.

As another example, alternatives to $SF_6$ at one atmosphere include, for example and without limitation, Octafluorocyclobutane ($C_4F_8$), Perfluorobutane ($C_4F_{10}$), 1,2-Dichlorotetrafluoroethane ($CF_2ClCF_2Cl$), Dichlorodifluoromethane ($CF_2Cl_2$), or Perfluoropropane ($C_3F_8$).

In addition to liquid or gas insulation, solid insulation can also provide adequate insulation between switch contacts or electrodes. A solid insulation of sufficient dielectric strength can be employed in place of the liquid insulation 6 in the arc flash arresters 8,100,110 of FIGS. 1-5 and 7. A solid insulation typically has a much higher breakdown strength than that of gas or even liquid insulation. The challenge in employing a solid insulation is to choose a material that can be penetrated by a movable contact, such as the bullet conductor 10 of FIG. 8, and still make good contact with a fixed stationary contact or electrode, such as the fixed contact 12' of FIG. 8.

Figure 9:
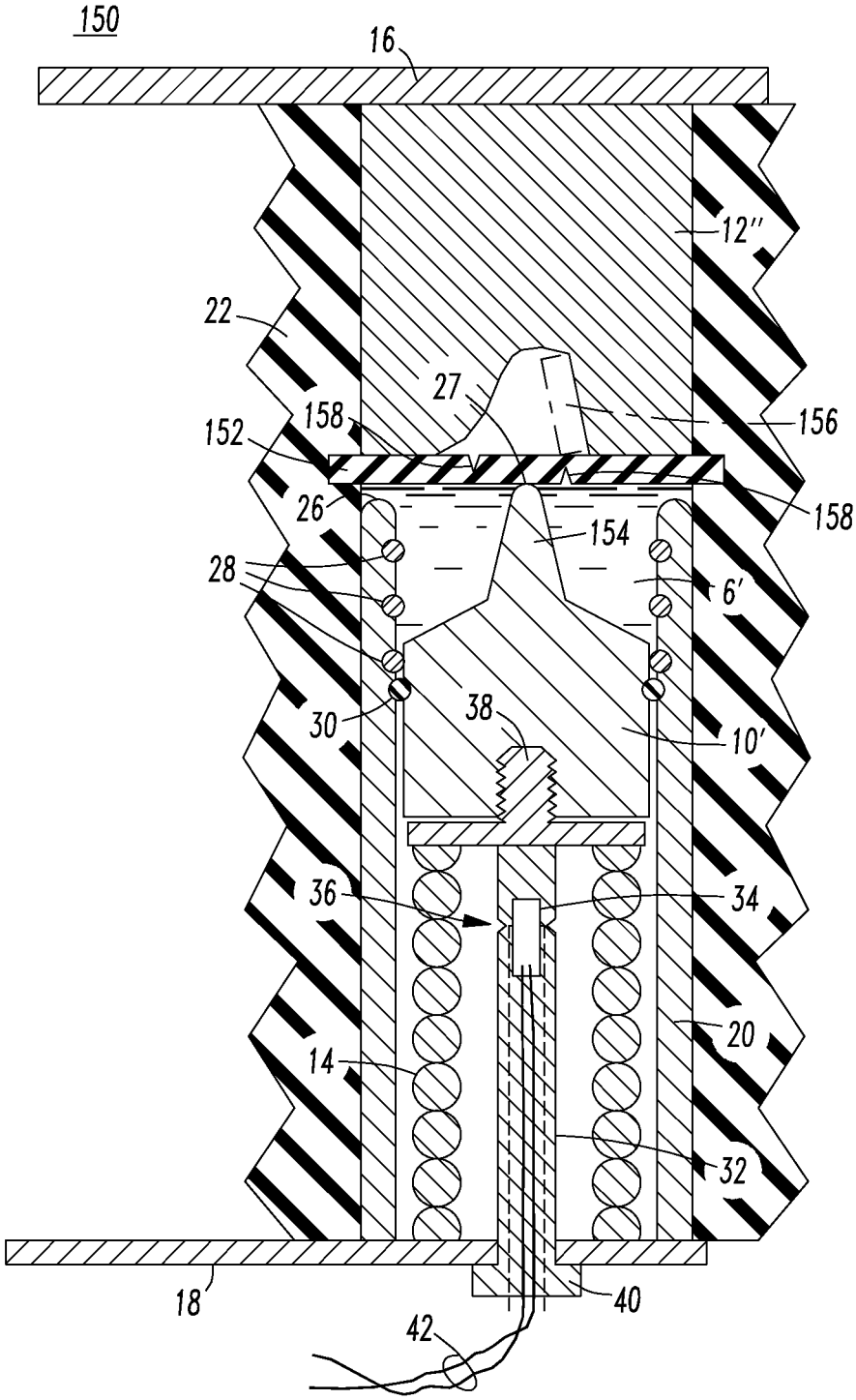
FIG. 9 is a cross sectional view of a solid insulated arc flash arrester employing a compression spring in an open position in accordance with another embodiment of the disclosed concept.

FIG. 9 shows the open position of a solid insulated arc flash arrester 150 including the compression spring 14 of FIGS. 1 and 2. It will be appreciated, however, that any of the mechanisms of FIGS. 3-5, 6A-6B and 7 can alternatively be employed. Generally, the solid insulated arc flash arrester 150 is similar to the liquid insulated arc flash arrester 8 of FIG. 1, except that solid insulation 152 is employed instead of the liquid insulation 6 of FIG. 1, and except that the fixed contact 12" does not employ a diaphragm 2 or a liquid exhaust port 4, and the movable contact 10' are different. A person of ordinary skill in the art will recognize that the liquid insulation 6 of FIG. 1 cannot be compressed and needs to exit the liquid exhaust port 4, whereas the solid insulation 152 of FIG. 9 may be displaced during movement of the movable contact 10'. Otherwise, closure of the solid insulated arc flash arrester 150 operates similar to that of the liquid insulated arc flash arrester 8 of FIG. 1.

Figure 12:
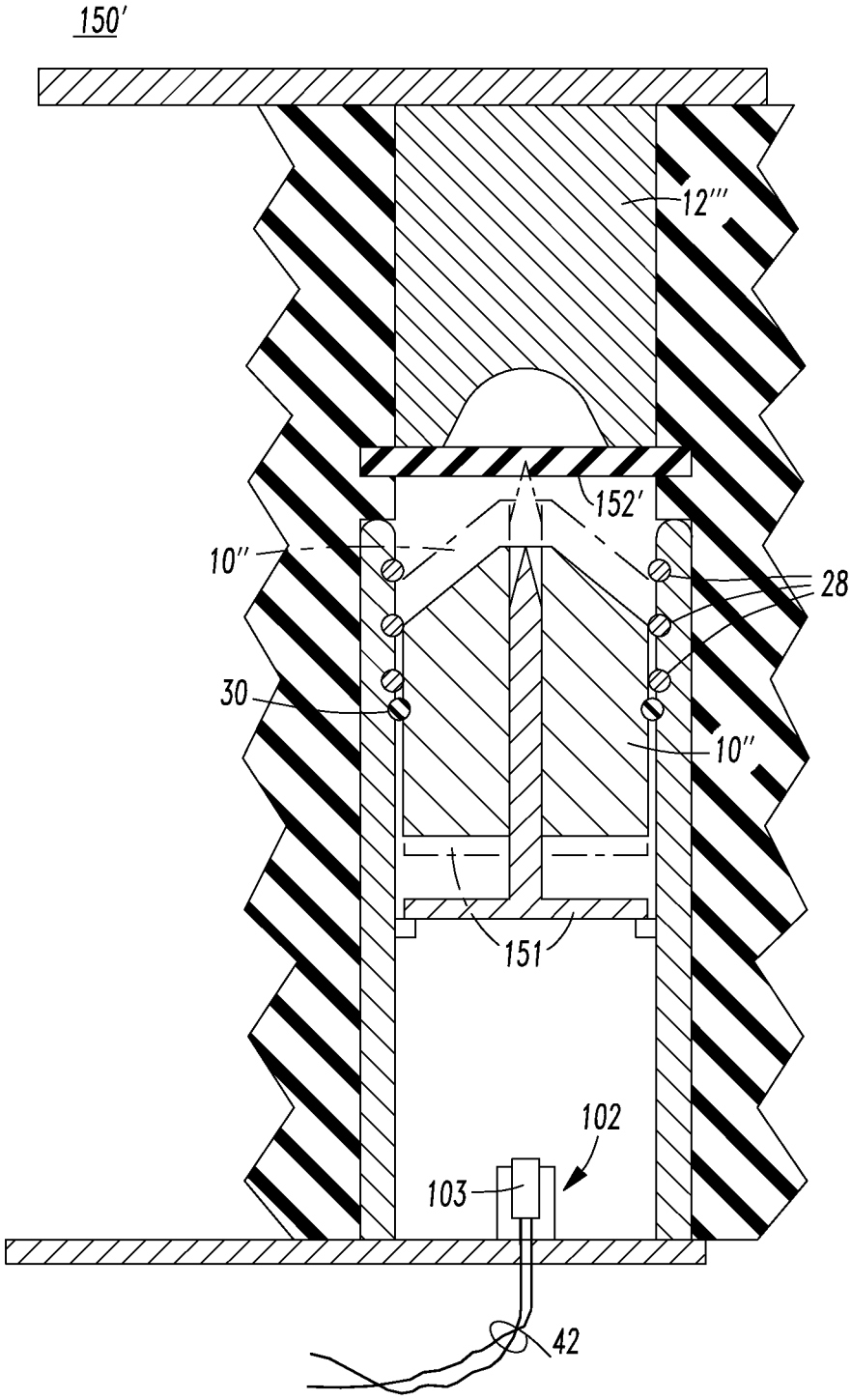
FIG. 12 is a cross sectional view of a solid insulated arc flash arrester employing an air bag actuator in an open position in accordance with another embodiment of the disclosed concept.

The solid insulation 152 may be, for example and without limitation, either a brittle type of solid dielectric, that can be shattered, or one that can be sliced through by a relatively sharp-nosed bullet conductor, such as a rubber. One problem is that too sharp a bullet conductor will create a very high enhancement factor that will lead to dielectric breakdown. As a result, the radius of the bullet nose 154 of the movable contact 10' of FIG. 9 is kept larger than about a 1/16" radius. Also, the shape of the fixed contact 12" is such that a portion 156 (shown in phantom line drawing) of the solid insulation 152 is displaced out of the way to ensure a good electrode contact, as shown in FIG. 9. Alternatively, as shown with the arrester 150' in FIG. 12, recessed needle 151 or sharp edge (not shown) could be recessed within a bullet 10" and extend (as shown in phantom line drawing) upon movement of the bullet to pierce solid rubber insulation 152'. Otherwise, the arrester 150' functions similar to the arrester 150 of FIG. 9. Here, optional liquid insulation need not be employed.

Various example solid insulations and their corresponding dielectric strengths in Table 2, below, can be employed as the solid insulation 152.

TABLE 2

| Solid | Breakdown Strength (kV/cm) |
|---|---|
| Glass ($Si0_2$) | 3000 to 5000 |
| Ceramic ($AI_20_3$) | 3000 to 5000 |
| Natural rubber | 100 to 390 |
| Butyl rubber | 80 to 200 |
| Silicone rubber | 90 to 390 |
| Polyetherimine | 240 |

Continuing to refer to FIG. 9, there are example break lines 158 scribed on the solid insulation 152 to cause the portion 156 (shown in phantom line drawing) of the solid insulation 152 to crack and break away such that it does not get lodged between the movable contact 10' and the fixed contact 12", thus preventing a connection and short. The electrode shape is intended to assist in preventing the solid insulation 152 from getting between the contacts 10',12" when the movable contact 10' (e.g., bullet contact) is driven towards the fixed contact 12". Preferably, the various ends 24',26,27 around the contact gap are rounded and relatively smooth.

For medium voltage applications, the advantages of using insulation, other than a partial vacuum, are in the cost and ease of manufacturing. In the case of liquid or solid insulation, there is no need for sealing against positive or negative pressure against the switch enclosure. In contrast, both a vacuum vessel or envelope, or a pressurized gas must withstand the forces of atmospheric pressure over the life of the device. The disclosed liquid insulation 6 and solid insulation 152 do not have a pressure differential with respect to atmospheric air.

The disclosed voltage requirements are really driven by the BIL value of the system. Most 15 kV rated systems in the United States have an example 95 kV BIL rating, which means that the system cannot flash over to ground or phase-to-phase when subjected to an impulse waveform (1.2/50 μS) of 95 kV peak. So, besides the rated system voltage, the insulation really has to withstand the BIL voltage.

In the event that the solid insulation 152 might provide inadequate breakdown strength for the desired application, then an optional o-ring 30 and optional liquid insulation 6', which provides extra insulation, if needed, may be employed. In that case, the example fixed contact 12" would include a liquid exhaust port, such as the liquid exhaust port 4 of FIG. 1. The disclosed break through solid insulation 152 plus optional liquid insulation 6' of FIG. 9 is an option for both gas and liquid designs for low voltage systems and perhaps some medium voltage systems depending on the voltage levels.

FIG. 10 shows the open position of a gas insulated arc flash arrester 160 including the air bag actuator 102 and air bag charge 103. Here, the gas insulation 142 is disposed above (with respect to FIG. 10) solid insulation, such as the example diaphragm 144, and air 146. Otherwise, the gas insulated arc flash arrester 160 is similar to the gas insulated arc flash arrester 140 of FIG. 8.

FIG. 11 shows the open position of a liquid insulated arc flash arrester 170 including the air bag actuator 102 and air bag charge 103. Here, the liquid insulation 6 is disposed above (with respect to FIG. 11) solid insulation, such as the example diaphragm 46, and air 48. Otherwise, the liquid insulated arc flash arrester 170 is similar to the gas insulated arc flash arrester 160 of FIG. 10.

The disclosed concept provides arc flash arresters employing the liquid insulation 6 (FIGS. 1-5 and 7) or gas insulation 142 (FIG. 8) throughout an entire chamber (e.g., touching the movable contact 10), or employing the solid insulation 152 and an optional liquid insulation 6' (touching the movable contact 10' in FIG. 9), or employing solid insulation (e.g., diaphragms 144,46 shown in FIGS. 10 and 11) containing gas insulation 142 or liquid insulation 6 in a chamber separate from the movable contact 10.

The disclosed arc flash arresters 8,100,110,140,150,160 eliminate internal arc flash and protect equipment from damage.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An arc flash arrester comprising:

a fixed contact;

a movable contact;

an actuator mechanism structured to close said movable and fixed contacts; and insulation disposed between said fixed and movable contacts in an open position of said arc flash arrester, wherein said insulation is not air at less than or equal to a pressure of 0.10857 MPa.

2. The arc flash arrester of claim 1 wherein said insulation is a liquid insulation.

3. The arc flash arrester of claim 2 wherein said liquid insulation is selected from the group consisting of mineral oil, pure mineral oil, polybutylene, alkyl-benzene, silicone oil, tetrachloroethylene, a high temperature hydrocarbon, and perfluoropolyether.

4. The arc flash arrester of claim 2 wherein said liquid insulation has a breakdown strength of at least about 50 kV/cm.

5. The arc flash arrester of claim 1 wherein said insulation is a pressurized gas insulation at a pressure of at least two atmospheric pressures.

6. The arc flash arrester of claim 1 wherein said insulation is a gas insulation selected from the group consisting of air at a pressure of at least about four atmospheric pressures, $SF_6$ at a pressure of at least about one atmospheric pressure, nitrogen at a pressure of at least about five atmospheric pressures, and argon at a pressure of at least about five atmospheric pressures.

7. The arc flash arrester of claim 1 wherein said insulation is a solid insulation.

8. The arc flash arrester of claim 7 wherein said solid insulation has a breakdown strength of at least about 80 kV/cm.

9. The arc flash arrester of claim 7 wherein said solid insulation is selected from the group consisting of glass, ceramic, natural rubber, butyl rubber, silicone rubber, and polyetherimine.

10. The arc flash arrester of claim 7 wherein said solid insulation is selected from the group consisting of a brittle, solid dielectric structured to be shattered by said movable contact, and a flexible, solid dielectric structured to be sliced by said movable contact.

11. The arc flash arrester of claim 7 wherein said solid insulation comprises a planar member including a plurality of break lines thereon; and wherein said break lines are structured to cause a portion of said planar member to crack and break away when contacted by said movable contact moving toward said fixed contact.

12. The arc flash arrester of claim 1 wherein said arc flash arrester is structured to operate across a low voltage.

13. The arc flash arrester of claim 1 wherein said arc flash arrester is structured to operate across a medium voltage.

14. The arc flash arrester of claim 1 wherein said actuator mechanism is an air bag actuator structured to drive said movable contact into contact with said fixed contact.

15. The arc flash arrester of claim 1 wherein said actuator mechanism is an electromagnetic actuator structured to drive said movable contact into contact with said fixed contact.

16. The arc flash arrester of claim 1 wherein said actuator mechanism comprises a compression spring member structured to drive said movable contact into contact with said fixed contact.

17. The arc flash arrester of claim 1 wherein said insulation is a liquid insulation or a gas insulation other than air disposed between said movable contact and said fixed contact, and touching said movable contact, said gas insulation other than air being pressurized at a pressure of at least one atmospheric pressure.

18. The arc flash arrester of claim 1 wherein said insulation is a liquid insulation or a gas insulation disposed between said movable contact and said fixed contact; and wherein said liquid insulation or said gas insulation is disposed in a chamber separate from said movable contact.

19. The arc flash arrester of claim 18 wherein said chamber is a first chamber; and wherein said movable contact is disposed in a second chamber separated from said first chamber by frangible solid insulation.

20. The arc flash arrester of claim 2 wherein said fixed contact comprises a conduit therethrough; wherein said conduit includes an opening facing said movable contact in the open position of said arc flash arrester; wherein said opening is covered by a diaphragm; wherein said liquid insulation touches said diaphragm in the open position of said arc flash arrester; and wherein said movable contact is structured to break said diaphragm when moving to a closed position of said arc flash arrester and expel part of said liquid insulation through the broken diaphragm and through the conduit of said fixed contact prior to engaging said fixed contact.

21. The arc flash arrester of claim 1 wherein said fixed contact is separated from said movable contact by at least about 1 cm in the open position of said arc flash arrester.

22. The arc flash arrester of claim 1 wherein said movable contact comprises a bullet structured to engage said fixed contact in a closed position of said arc flash arrester.

23. The arc flash arrester of claim 22 wherein said bullet includes a nose having a radius larger than about 1/16 of an inch.

24. The arc flash arrester of claim 22 wherein said bullet is carried by a conductive conduit in both of the open position and the closed position of said arc flash arrester.

25. The arc flash arrester of claim 24 wherein a first conductive bus is electrically coupled to said fixed contact; wherein a second conductive bus is electrically coupled to the conductive conduit; and wherein said second conductive bus is electrically coupled to said first conductive bus by said conductive conduit, said bullet and said fixed contact in the closed position of said arc flash arrester.

26. An arc flash arrester comprising:

a fixed contact;

a movable contact;

an actuator mechanism structured to close said movable and fixed contacts; and insulation disposed between said fixed and movable contacts in an open position of said arc flash arrester, wherein said insulation is selected from the group consisting of liquid insulation; $SF_6$; a gas, other than $SF_6$ or air, at a pressure of at least about one atmospheric pressure; and solid insulation.

27. The arc flash arrester of claim 1 wherein said insulation is not air at less than or equal to a pressure of 0.15 MPa.

* * * * *